US007669331B2

(12) United States Patent
Sohl et al.

(10) Patent No.: US 7,669,331 B2
(45) Date of Patent: Mar. 2, 2010

(54) ROLL AND METHOD FOR THE MANUFACTURE OF SUCH A ROLL

(75) Inventors: Carsten Sohl, Fredericia (DK); Per Grynnerup, Fredericia (DK)

(73) Assignee: Schafer Composites GmbH (DE)

( * ) Notice: Subject to any disclaimer, the term of this patent is extended or adjusted under 35 U.S.C. 154(b) by 1056 days.

(21) Appl. No.: 11/106,084

(22) Filed: Apr. 14, 2005

(65) Prior Publication Data

US 2005/0233880 A1 Oct. 20, 2005

(30) Foreign Application Priority Data

Apr. 15, 2004 (DE) ..... 10 2004 019 306

(51) Int. Cl.
*B21K 1/02* (2006.01)
*A01B 29/06* (2006.01)

(52) U.S. Cl. ..... 29/895.2; 492/30; 492/40; 492/41; 492/48; 492/51; 492/52; 492/53; 29/895.21; 29/895.213; 156/187

(58) Field of Classification Search ..... 492/50, 492/51, 52, 53, 56, 43, 30, 44, 45, 48, 40, 492/41, 47; 156/172, 182, 187, 190, 195; 29/895.2, 895.21, 895.212, 895.213, 895.22, 29/895.3
See application file for complete search history.

(56) References Cited

U.S. PATENT DOCUMENTS 1,884,104 A * 10/1932 Moore et al. ..... 29/895.1
3,646,651 A * 3/1972 McGaughey et al. ..... 492/52
4,368,568 A * 1/1983 Watanabe ..... 492/52
4,475,275 A * 10/1984 Edwards ..... 29/895.213
4,503,769 A * 3/1985 Andersen ..... 101/153
4,604,778 A * 8/1986 Edwards ..... 492/40
4,866,826 A * 9/1989 Koide ..... 29/895.3
5,091,027 A * 2/1992 Watanabe ..... 156/172
5,097,596 A * 3/1992 Hoogesteger et al. .... 29/895.21
5,307,563 A 5/1994 Svenka
5,601,920 A * 2/1997 Paasonen et al. ..... 428/375
5,766,120 A 6/1998 Schmitz
5,780,131 A * 7/1998 Paasonen et al. ..... 428/35.9
5,952,017 A * 9/1999 Nishida et al. ..... 425/363
5,958,533 A * 9/1999 Paasonen et al. ..... 428/36.5
6,375,602 B1 4/2002 Jones
6,409,645 B1 * 6/2002 Paasonen et al. ..... 492/56
6,432,031 B1 * 8/2002 Paasonen et al. ..... 492/56
6,514,369 B1 * 2/2003 Shieh ..... 156/154
6,776,744 B1 * 8/2004 Shieh ..... 492/56
6,793,754 B1 * 9/2004 Shieh ..... 156/172
6,896,647 B1 * 5/2005 Karger et al. ..... 492/50
7,051,554 B2 * 5/2006 Hart ..... 65/370.1
2002/0189749 A1 * 12/2002 Shieh ..... 156/172

* cited by examiner

*Primary Examiner*—Essama Omgba
(74) *Attorney, Agent, or Firm*—Akerman Senterfitt

(57) ABSTRACT

A calender roll, which was already in use and has a metallic core with engaged textile material sheets, can be worked for a new use. In the surface of the sheets are cut grooves, to which is subsequently applied a layer structure of synthetic resin-impregnated fibrous material forming a certain thickness over each point of the roll. Onto said layer can be applied a functional covering, for example of rubber.

25 Claims, 2 Drawing Sheets

ROLL AND METHOD FOR THE MANUFACTURE OF SUCH A ROLL

The following disclosure is based on German Patent Application No. 10 2004 019 306.1 filed on Apr. 15, 2004, which is herewith incorporated into this application by explicit reference.

FIELD OF APPLICATION AND PRIOR ART

The invention relates to a roll or calender roll, as well as to a method for the manufacture of a roll.

In construction and process engineering use is frequently made of treatment devices such as punches or punch surfaces, presses or rotary rolls, which have a multilayer structure. Such a multilayer structure can be desired in order to achieve particular strength characteristics or behaviour. Cases can also arise in which already existing treatment devices have to be modified or reconstructed, for example provided with new surfaces. Difficulties more particularly arise if on an already existing covering or substructure a further layer structure has to be applied, whose mechanical characteristics do not necessarily bring about harmony or which cause difficulties.

One example is constituted by calender rolls, which have a covering as the top layer and which is made from a paper or textile material. There are in particular calender rolls, whose covering comprises a plurality of textile material or cotton fabric sheets, which are engaged on a metal core and strongly compressed in the axial direction. These rolls form a covering or surface having a certain elasticity and which is relatively favourable and in the case of wear can be dressed to a certain extent in order to once again obtain a uniform, smooth surface. In order to be able to use existing rolls for the formation of a new covering or layer system, attempts have been made to slide a precisely matching metal cylinder onto the textile layer and then apply thereto a layer of plastic or rubber for example. However, the problem arises that the diameter of the metal tube must precisely match the roll diameter, because otherwise mechanical problems arise.

Problem and Solution

The problem of the invention is to provide a roll and a method for the manufacture of the roll making it possible to avoid the problems of the prior art and which in particular enable in an inexpensive and technically advantageous manner to apply a further layer structure to existing treatment devices.

This problem is solved by a roll having a hard substructure and a covering several centimeters thick of a material in the form of paper or textile material on the substructure. The covering includes a plurality of individual, thin layers, which are compressed or pressed together along an axial direction of the roll such that outer edges of the sheets form a surface of the roll, the surface of the roll being structured with grooves or depressions, liquid plastic applied as an adhesive to said structuring, and a stabilizing fibrous material layer applied to the liquid plastic, wherein the fibrous material layer is impregnated with liquid plastic and the covering is built up from sheets, the sheets being engaged on the substructure in a direction perpendicular to the axial direction of the roll and stacked one on another along the axial direction has been inserted. The problem is also solved by a method for the manufacture of such a roll. Advantageous and preferred developments of the invention form the subject matter of the claims and are explained in greater detail hereinafter. By express reference the wording of the claims is made into part of the content of the present description. Features concerning the technical design, as well as the treatment device, together with the method in part apply to both and are only explained once hereinafter. These explanations relate both to the treatment device and to the method.

According to the invention a treatment device has a hard substructure to which is applied a covering of paper or textile material having a certain thickness, more particularly several centimeters. The covering comprises a plurality of individual, thin paper or textile material layers. The latter are compressed or pressed together to give a certain dimensional stability. This paper or textile material covering undergoes surface structuring. To it is applied plastic, particularly a liquid plastic, which has the effect of an adhesive and also provides a mechanical connection, particularly for load transfer purposes. In turn to it is applied a fibrous material stabilizing layer. The latter is also impregnated with plastic, which cures and together with the fibrous material forms a stable, fibre-reinforced layer.

Thus, through the plastic and fibrous material is formed an intermediate layer, which in turn has an adequate strength. As a result of the structuring of the surface of the covering below the same it is once again ensured that the plastic deeply penetrates the paper or textile material and at least impregnates a portion thereof. This brings about a particularly good adhesion in addition to the actual structuring and also leads to a good mechanical connection, particularly for load transfer. Particularly in the case of paper or textile material as a result of structuring the surface can be opened, so that liquid plastic or adhesive can penetrate. As a result of the following stabilizing layer with fibrous material firstly a relatively smooth surface of the treatment device is again provided, so that the structuring is compensated and secondly a stable layer results from the composite of fibrous material and plastic or adhesive.

With particular preference the treatment device is a roll, particularly a calender roll, or this is used so that a new treatment device can be produced with the described method. After finishing as a calender roll, such a roll can form a rolling mill with a metal counterroll, for example for smoothing paper surfaces. Onto the previously described stabilizing layer a cover layer can be applied for this purpose and is advantageously made from plastic or rubber. It can have a thickness of a few millimeters to a few centimeters and can be adapted as regards its hardness and other properties to the intended use.

An advantageous textile material is cotton. More particularly the textile material comprises a cotton fabric, such as is used for jeans and the like. This permits a relatively favourable availability. Further possibilities are the provision of pieces of wool or synthetic fibres in the textile material, for example under the trade name Nomex.

A substructure of the treatment device or roll is preferably metallic in order to ensure an adequate strength. In particularly preferred manner it is a solid or hollow metal core, which in the case of a roll also forms the rotation axis.

Paper or textile material sheets can be applied to a substructure or in the case of a roll can be engaged on a roll core and in this way form the covering, being compressed or pressed together for this purpose. In the case of a roll this is advantageously brought about by tightening means at the ends, which can be nuts to be screwed on, for example.

The structuring of the surface of the covering can have grooves, for example, which can have a variable depth as a function of the covering thickness and other requirements. The depth can be between 3 and 20 mm, for example somewhat under 10 mm. It is considered advantageous to provide a uniform, unitary structuring, i.e. only having grooves. The latter can all be equidistant and are advantageously closely juxtaposed. As a result of a directly interconnecting application of the grooves, there is a very large number of these per surface unit and consequently there is a considerable adhesion-improving effect. This also improves the mechanical connection with respect to the load transfer. Thus, mechanical loads can be better transferred from the outer layer to the roll core.

In the case of a roll, preferably a surface structuring is such that it only runs in the rotation direction with no or only a limited longitudinal component, mainly in the axial direction of the roll. Otherwise in the case of rotating rolls, from a pressure along the nip line of a calender rolling mill a force and motion action of the top covering with deflection in the longitudinal direction of the axis could be brought about and this is obviously to be avoided. Thus, grooves run substantially or advantageously exclusively in the rotation direction in the form of closed, circular grooves. It is also possible to provide a groove in the form of a screw thread. As a result the indicated characteristics are still achieved, but not in quite such a satisfactory manner.

Another possibility for a surface structuring, which in certain circumstances can be provided in addition to the aforementioned elongated grooves is constituted by advantageously conical holes or depressions, which should be uniformly distributed. It is also advantageous and favourable from the manufacturing standpoint for them to have roughly the same size. They can be applied to rotating rolls by drills or arbors and in certain circumstances by laser beams.

The plastic or adhesive can be a resin, such as a synthetic resin, for example, or epoxy resin. A plastic can advantageously be a thermosetting plastic.

The fibrous material is advantageously constituted by very stable reinforcing fibres. They are with particular advantage applied in the form of rovings, that is a continuous fibre bundle. A fibrous material is preferably selected from the following group: glass, carbon, aramid or boron fibres.

The application of the fibrous material to a roll as the treatment device can take place by rotating the roll and winding on the fibrous material. On winding on the fibrous material it must be ensured that it is compressed and the fibres are applied uniformly and in closely juxtaposed manner. In a first pass it is possible to fill the grooves or depressions for obtaining a planar surface and then a further fibrous material layer can be applied. Alternatively and in a single pass the fibrous material can be applied in the desired thickness. It is considered advantageous if the fibrous material is applied already impregnated with liquid plastic or adhesive. Following the hardening of the plastic or adhesive a further covering can either be directly applied or firstly the surface is smoothed, for example abraded. The top covering can be constituted by a polymer material, for example rubber or plastic.

BRIEF DESCRIPTION OF THE DRAWINGS

Embodiments of the invention are described in greater detail hereinafter relative to the attached drawings, wherein show.

DETAILED DESCRIPTION OF THE EMBODIMENTS

Figure 1:
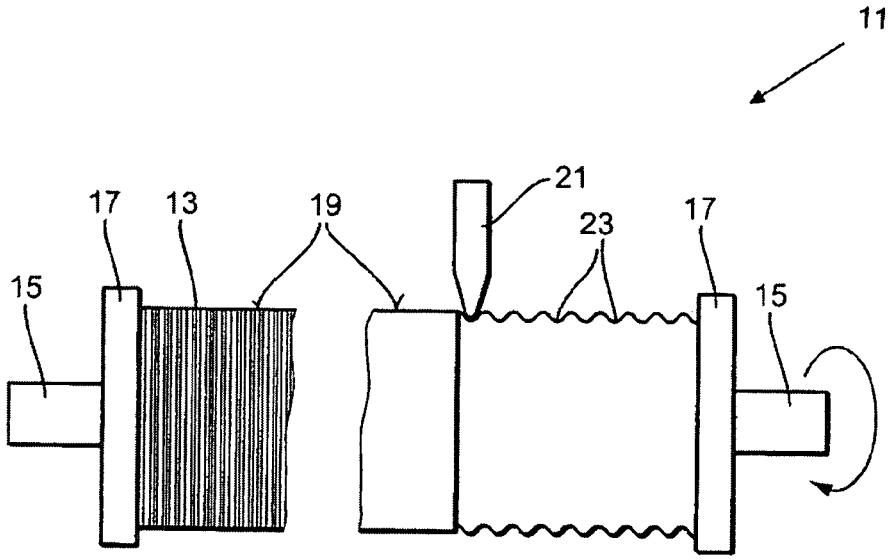
FIG. 1 A calender roll with textile covering, which is provided with a surface structuring with grooves according to the invention by rotating.

FIG. 1 shows a calender roll 11 comprising a plurality of sheets 13 of the aforementioned paper or textile material. The sheets 13 are engaged on a core 15 also having shaft ends. The paper sheets 13 are compressed by two holding disks 17 at the left and right-hand ends. In normal operation they form a smooth surface 19, as can be seen to the left in FIG. 1.

For the treatment according to the invention, using a cutting tool 21 and in accordance with a conventional turning process, the surface 19 or sheets 13 are treated, so as to cut in grooves 23. The grooves 23 are precisely parallel, directly follow on to one another and always equidistantly spaced run precisely in the circumferential direction on roll 11.

Figure 2:
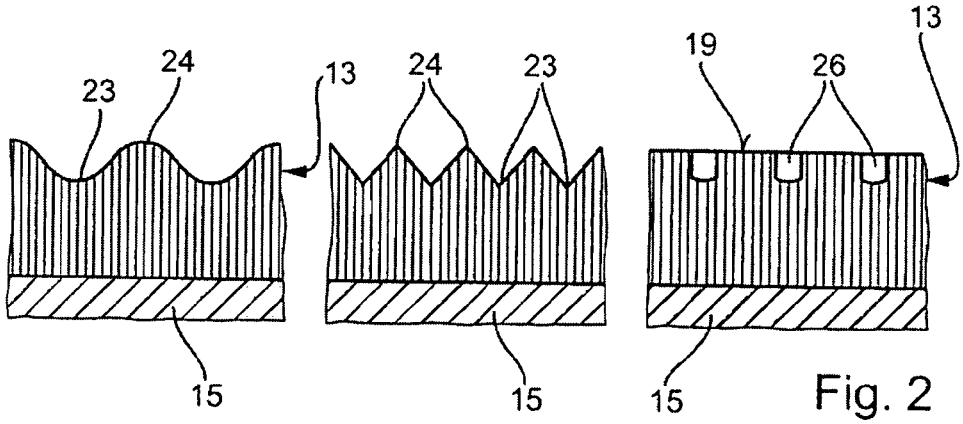
FIG. 2 Alternative surface structurings with grooves and holes juxtaposed for comparison purposes.

It is clear from the larger scale reproduction of groove structures in FIG. 2 how the same can be formed. As shown to the left, they can be constructed with gentle transitions and therefore also gentle or rounded tips or points 24. As shown to the right, they can also be relatively acute angled. The flanks between the tips 24 and the lowest point of the grooves 23 are advantageously straight here, although this is not necessary.

On carefully working the surface 19 of roll 11 using cutting tool 21, the outer edges of the individual sheets 13 do not become ragged and are instead cut relatively smooth. This means that they can be worked in the same way as a solid material. However, as a result of the working, the surface or overall surface formed of the directly following on outer edges of the sheets 13 acquire a structure which is opened from the outside or which is accessible for liquid, as will be explained hereinafter.

To the far right in FIG. 2 is shown as a further alternative a structuring where holes or blind holes 26 can be formed in the surface 19. This can for example take place by drilling or with laser beams or the like. As shown, the holes can be in the form of purely cylindrical blind holes, but can also taper downwards.

Figure 3:
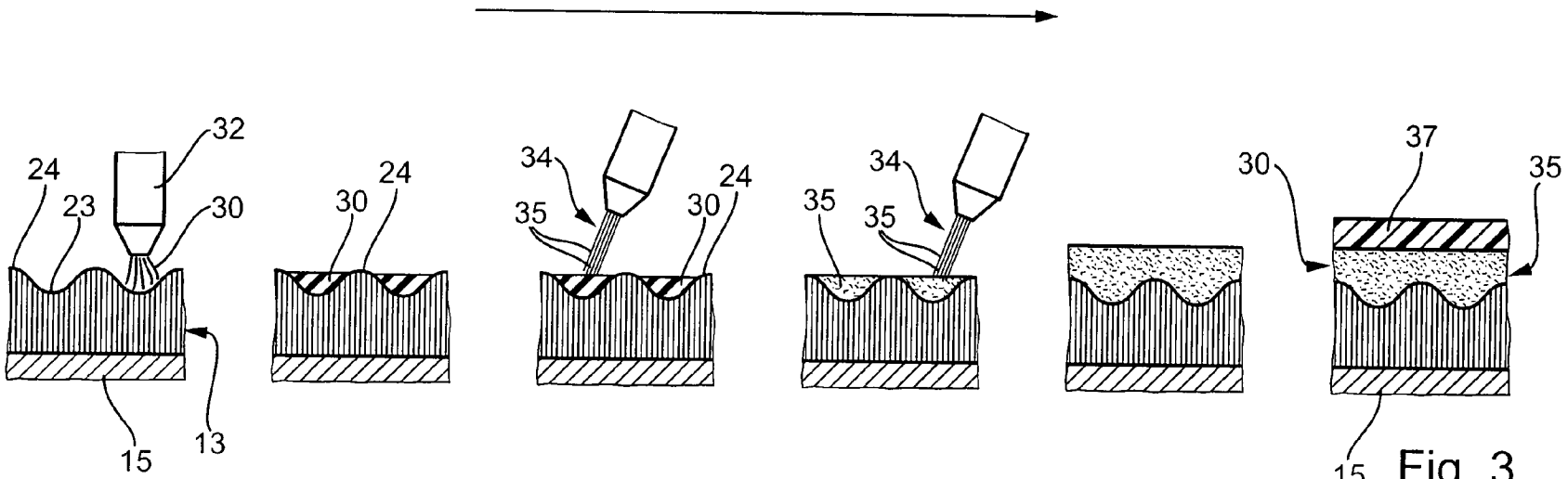
FIG. 3 Several partial representations of a surface of a treatment device, for example a calender roll according to FIG. 1, with the different processing steps.

FIG. 3 shows in a split representation the different steps illustrating how starting with a treatment device with grooves 23, for example the calender roll 11 of FIG. 1, the further layer structure can be applied. The basic surface structure is in accordance with FIG. 1, in which the holding disks 17 are already provided with the grooves 23.

In the first step according to FIG. 1 synthetic resin 30 is applied using a nozzle 32. The nozzle 32 can be replaced by any other applicator. As shown to the right, in the second step application takes place so that at least the grooves 23 are relatively well covered with the synthetic resin 30 and are advantageously not completely filled. Synthetic resin can be applied at this time to the tips 24. This is decisively dependent on the subsequent fibre application process.

In the third step in FIG. 3, rovings 34 comprising individual fibres 35 are wound on and can be applied in continuous form. As is apparent from the situation in the fourth step, the grooves 23 between the tips 24 are first roughly filled with the fibres 35. Then, in the fifth step, once again fibrous material 35, advantageously in the form of rovings 34, is applied together with further synthetic resin, but on this occasion is distributed over the entire surface. Thus, whereas in the first step the fibrous material 35 equalizes or fills the grooves 23 compared with the intermediate tips 24, now an entire covering fibrous material layer 35 is applied. This is used for strengthening the surface of the treatment device or roll 11 or the sheets 13. A more stable and cohesive substructure can be created for a subsequent layer structure.

In the fifth step the entire roll 11 is covered with a layer of fibrous material 35 impregnated with synthetic resin 30. This application of the layer or the production of the layer is to take place in such a way that the surface is already to some extent uniform and flat, either as a result of winding or subsequent working.

According to the next or sixth step, onto the completely cured fibre-reinforced synthetic resin material layer is applied a further polymer material covering 37, for example of rubber or plastic, as a function of the intended use. This, however, corresponds to the known method. With regards to this functional polymer material layer 37, as a result of the stable, intermediate, fibrous material layer 35, the roll behaves in a neutral manner and its characteristics are no longer influenced or characterized by the underlying structure of paper sheets 13. As a result of the improved mechanical connection it is better possible to transfer loads from the surface to the underlying roll 11.

The invention claimed is:

1. A roll for a treatment of flat materials by pressure, said roll having a hard core and a covering, several centimeters thick, on said core of paper or textile material, said covering comprising:

a plurality of individual, sheets, which are engaged on said core and are compressed or pressed together in an axial direction of the roll such that outer edges of the sheets form a surface of the roll, the surface of the roll being structured with grooves or depressions, liquid plastic applied as an adhesive to said structuring, and a stabilizing fibrous material layer applied to said liquid plastic, wherein said fibrous material layer is impregnated with said liquid plastic wherein said sheets are in a direction perpendicular to the axial direction of the roll and the sheets are stacked one on another along the axial direction.

2. The roll according to claim 1, wherein said roll is a calender roll for use with a metallic counterroll.

3. The roll according to claim 1, wherein said roll is constructed for smoothing paper surfaces.

4. The roll according to claim 1, wherein said textile material is cotton.

5. The roll according to claim 1, wherein said core is a hollow metal core.

6. The roll according to claim 1, wherein said sheets are compressed by tightening means and held on said substructure.

7. The roll according to claim 1, wherein said core is a roll core.

8. The roll according to claim 1, wherein only grooves are provided as structuring and said grooves are all equidistantly arranged in closely juxtaposed manner.

9. The roll according to claim 1, wherein said structuring is in an axial direction of said roll, without any longitudinal fraction, and has exclusively grooves running in a direction of rotation.

10. The roll according to claim 1, wherein said structuring comprises holes.

11. The roll according to claim 1, wherein said adhesive is a resin.

12. The roll according to claim 1, wherein said adhesive is a thermosetting resin.

13. The roll according to claim 1, wherein said fibrous material comprises reinforcing fibers applied in the form of rovings.

14. The roll according to claim 13, wherein said fibrous material is taken from the following group: glass, carbon, aramid and boron fibers.

15. The roll according to claim 1, wherein a surface of said stabilizing layer is substantially smooth and without structuring.

16. The roll according to claim 1, wherein a cover layer is applied to said stabilizing layer surface.

17. The roll according to claim 16, wherein said cover layer is chosen from among plastic or rubber.

18. A method for the manufacture of a roll for the treatment of flat materials by pressure, said roll having a covering with a thickness of several centimeters of a paper or textile material on a hard core, the method comprising the steps of:

building up said covering from individual sheets engaged on said core, said sheets being in a direction perpendicular to the axial direction of the roll and stacked one on another, and arranged along the axial direction of the roll such that outer edges of the sheets form a surface of the roll;

compressing said sheets together in the axial direction of the roll;

structuring said surface of said covering with grooves or depressions;

applying liquid plastic as adhesive to said structuring; and applying a stabilizing fibrous material to said liquid plastic, said fibrous material being also impregnated with said liquid plastic.

19. The method according to claim 18, wherein said grooves are introduced by rotating said roll and are applied as several, circumferentially directed, individual grooves.

20. the method according to claim 18, wherein, directly after said application of said plastic as an adhesive to said structured covering, said fibrous material is applied prior to the hardening of said plastic.

21. The method according to claim 18, wherein said fibrous material is also impregnated with adhesive prior to application.

22. The method according to claim 18, wherein said fibrous material is applied in the form of rovings.

23. The method according to claim 18, wherein at least a few millimeters of fibrous material layer are located on each point of said covering.

24. The method according to claim 18, wherein said fibrous material is applied in such a way that subsequently there is a substantially smooth or uniform roll surface.

25. The method according to claim 18, wherein a cover layer of a polymer material is applied to said stabilizing layer surface.

* * * * *